United States Patent [19]

Moody

[11] 3,937,037

[45] Feb. 10, 1976

[54] METHOD AND APPARATUS FOR KNITTING TERRY FABRIC

[75] Inventor: Robert J. Moody, Franklin, N.H.

[73] Assignee: Scott & Williams, Inc., N.H.

[22] Filed: Jan. 9, 1974

[21] Appl. No.: 431,686

[52] U.S. Cl. ..... 66/93; 66/108 R
[51] Int. Cl.[2] ..... D04B 9/12; D04B 15/24
[58] Field of Search ..... 66/93, 92, 108 R, 108 A, 66/107, 9 R

[56] References Cited

UNITED STATES PATENTS

| | | | |
|---|---|---|---|
| 1,038,638 | 9/1912 | Paquette | 66/108 R |
| 1,388,341 | 8/1921 | Holmes et al. | 66/93 |
| 1,457,903 | 6/1923 | Gagne | 66/108 R |
| 2,270,719 | 1/1942 | Smith, Jr. | 66/93 |
| 3,054,278 | 9/1962 | Haddad | 66/108 R X |
| 3,094,854 | 6/1963 | Fregeolle | 66/108 A |
| 3,173,277 | 3/1965 | Fregeolle | 66/107 |
| 3,362,196 | 1/1968 | Hin | 66/108 R |

FOREIGN PATENTS OR APPLICATIONS

| | | | |
|---|---|---|---|
| 692,960 | 8/1930 | France | 66/108 R |

*Primary Examiner*—Wm. Carter Reynolds
*Attorney, Agent, or Firm*—McNenny, Farrington, Pearne & Gordon

[57] ABSTRACT

A method and means for improving quality of terry fabric by controlling the position of terry loops as they are cleared on the needles. A special sinker actuating cam assembly is arranged to withdraw and then readvance the sinkers, after the terry loops have been drawn, to transfer these loops into their respective sinker throats prior to raising of the needles to clear height whereby clearance and subsequent avoidance of the terry loops by the needle latches are assured. Additional sinker cams for selectively changing the timing of sinker motion for bare needle makeup and, alternately, for knitting terry fabric, and for withdrawing the sinkers at the point of transfer are also disclosed.

8 Claims, 8 Drawing Figures

METHOD AND APPARATUS FOR KNITTING TERRY FABRIC

BACKGROUND OF THE INVENTION

The invention relates to improvements in circular knitting of plush or terry fabric, and more specifically relates to a method and means for improving the quality of knitted terry fabric.

Terry fabric may be produced by knitting a backing yarn into a stable structure while simultaneously knitting a terry yarn into loose loops superimposed on the backing yarn, such as in a plated relationship. To develop its relatively longer loops, the terry yarn may be fed and drawn over special sinker ledges separate from the more conventional ledges on which the backing yarn is knit. The terry loop ledges are arranged with a greater spacing from the needle hooks at their fully drawn position than the corresponding spacing of the backing yarn ledges. This known method of knitting is disclosed, for example, in U.S. Pat. No. 3,293,886 to Nebel.

A recurrent problem experienced with the production of such terry fabric has been formation of random fabric flaws, where the terry loops have been misknitted. These flaws usually result from a tucking defect in the fabric where a terry loop fails to clear the needle latch when the needle rises to clear height, or where the latch descends from clear height back through a previously cleared loop.

SUMMARY OF THE INVENTION

The invention provides means by which the position of terry loops is precisely controlled during the knitting process to ensure that such loops may be reliably cast off when desired. Such loop control is effected by special sinker motion developed after drawing of the yarn into stitches. In accordance with the invention, the sinkers have a configuration which provides separate loop drawing ledges for separately forming the regular backing yarn loops and the relatively longer terry loops. The sinkers are withdrawn from the needle circle after these stitches have been completely formed to allow the terry loops to slip off their respective ledges. The sinkers are then returned towards the needle circle to cause the terry loops to be captured in the sinker throats before the needles are raised to clear height. The terry loops are thus retained against frictionally produced upward movement with the needles so that subsequent clearing of the needle latches is assured. Engagement of the terry loops in the sinker throats also prevents unwanted tuck stitches resulting from accidental movement of the needle latches through previously cleared loops.

In the preferred embodiment, a sinker cam ring includes cam means for successively withdrawing and readvancing the sinkers to transfer the terry loops to the sinker throats while the needles remain at the welt position. With the needles out of reciprocating movement at the welt position during this sinker withdrawal and advance movement, variations in knitting results are minimized.

In accordance with other aspects of the invention, the sinker cam ring includes selectively operable sinker advance cam means at a yarn feed station for advancing the sinkers relatively early for proper feeding of the yarn during knitting of terry fabric and, alternatively, for advancing the sinkers with a more conventional, or later, movement during bare needle makeup. Additionally, the sinker cam ring includes a sinker withdrawal cam at a transfer station to prevent the knitted loops from being distorted on the sinkers during transfer operations.

DESCRIPTION OF THE PREFERRED EMBODIMENT

Figure 1:
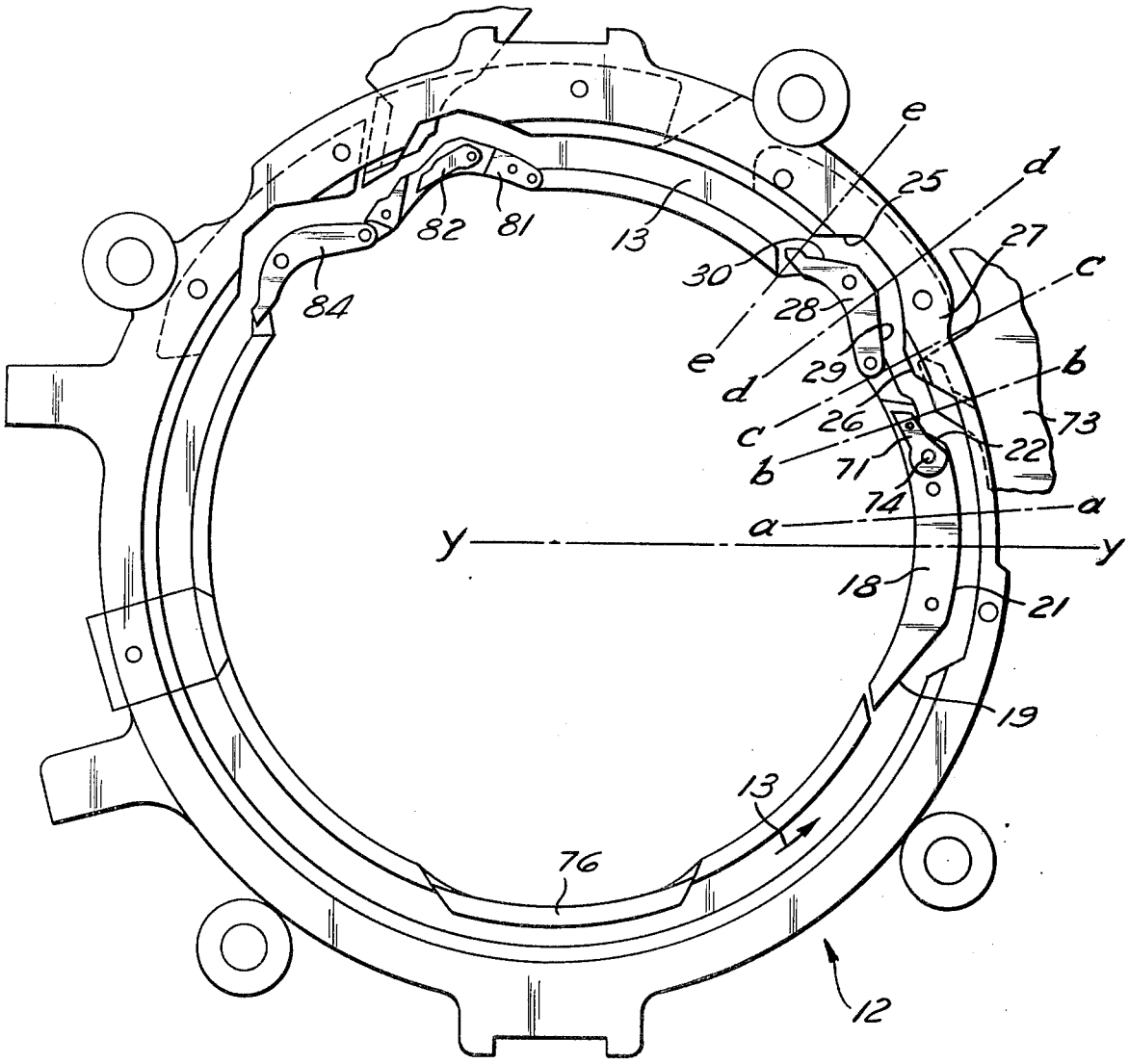
FIG. 1 is a plan view from the bottom of a sinker cam ring of a circular knitting machine incorporating the principles of the present invention.
Figure 2:
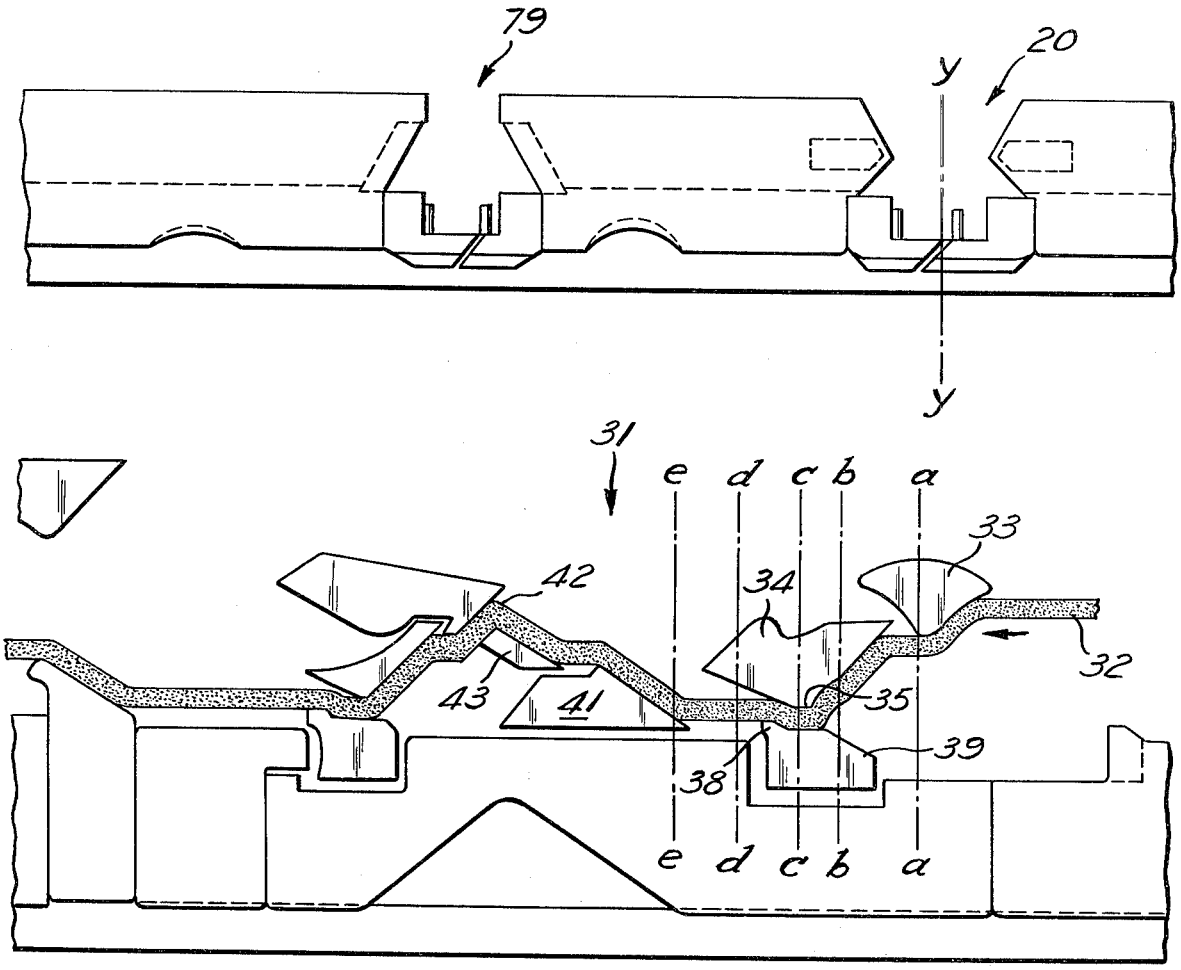
FIG. 2 is an elevational developed view of a set of needle cylinder cams and associated yarn feeding stations in a typical circular knitting machine.

FIGS. 1 and 2 illustrate cam arrangements for controlling the motion of sinkers 10 and needles 11, respectively, generally according to conventional practice, with the exception of certain sinker cams to be described hereinafter. FIGS. 3*a* through 3*e* illustrate the combined effect of the sinker and needle cams where sinkers 10 and needles 11 are shown forming plated stitches of terry and regular yarn.

A sinker cam ring body 12, according to conventional practice, provides an endless, generally circular path 13 through which sinker butts 14 pass in a counterclockwise direction as viewed in FIG. 1. On the sinker cam ring 12 is mounted a central sinker cam 18 which includes a camming surface 19 for withdrawing the sinkers from the needle circle preparatory to the feeding of yarn at a main yarn feed station 20, represented in FIG. 1 by its centerline *y—y*. Beyond a dwell portion 21 of the central sinker cam 18 there is provided a preadvance surface 22 which allows the sinkers to be moved by a cam body 73 radially inward or advanced toward the needle circle in a zone between the main feed station 20 and a stitch drawing station defined by a stitch cam 34 (FIG. 2). A limited distance along the path 13, a surface 26 of a sinker knockover cam 27 causes the sinkers 10 to reach their maximum inward position, termed "sinker knockover." Following this, in accordance with the invention, the sinker butts 14 reach means for temporarily withdrawing and then readvancing the sinkers 10 in the form of a cam 28 which, through a limited angular distance, causes the needle butts 14 to shift radially outwardly and then allows a return to a generally circular path. As shown, the sinker withdrawal cam 28 includes a first surface 29 for retracting or moving the sinkers 10 radially outward and a trailing surface 30 for allowing the sinkers to move radially inward under a driving influence of a surface 25 of the cam 27 toward the needle circle again.

A path 32 of needle butts is illustrated in FIG. 2, representing the knitting of plain or jersey fabric. The center of the main feed station 20 is again indicated by the centerline *y—y*. A needle cam set 31 includes a top center cam 33, which draws the needle butts down for engagement with a stitch cam 34. Upon reaching a lowermost portion 35 of the stitch cam 34, the needles are at knockover or their position of full draw. Shortly after this point 35, the needles are raised to welt position by a leftward portion 38 of a stitch cam block 39. The needles remain at welt height for a measurable distance until they contact a needle tuck cam 41 and they are raised to tuck height. Following this, the needles are further raised to clear height 42 by a needle clear cam 43.

Figure 4:
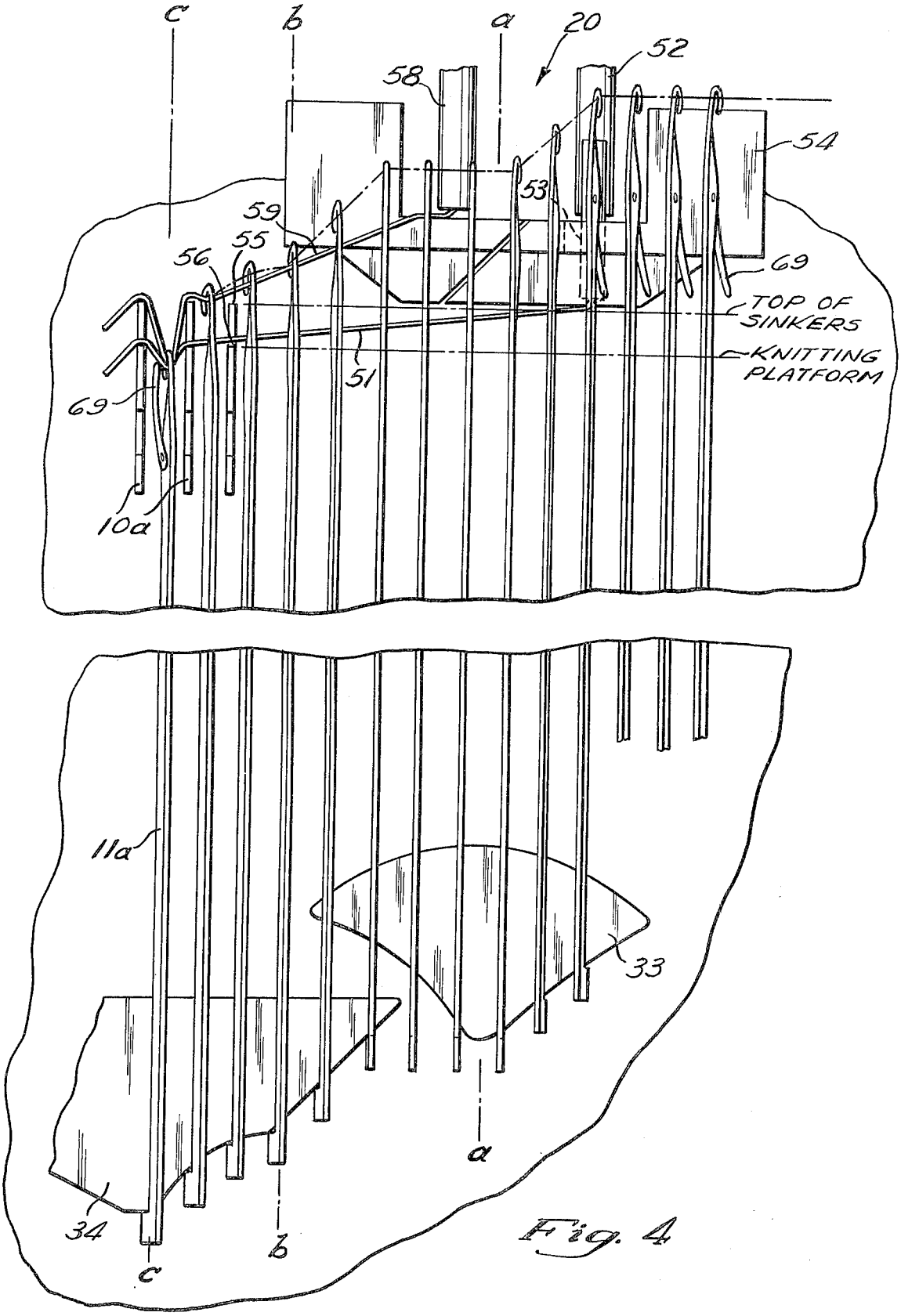
FIG. 4 is a fragmentary, elevational view of the knitting elements and yarn paths adjacent a yarn feeding station in the knitting machine.

Referring to FIG. 4, a regular or normally knit backing yarn 51 is fed at a relatively low level by a rightward yarn finger 52 extending through a hole 53 in a throat plate 54 of the feed station 20. As shown, the yarn 51 is presented to the sinkers 10 below their uppermost surfaces 55, indicated by a broken line with the legend "top of sinkers" and above the "knitting platform" formed by lower ledges 56. A second feed finger 58 supplies terry or plush yarn 59 across the throat plate 54 so that it is laid over upper sinker surfaces or ledges 55. For the sake of clarity in the drawings, only a limited number of sinkers 10 is shown in the left portion of FIG. 4, but it is to be understood that a sinker is provided between each pair of adjacent needles.

In FIGS. 3*a* through 3*e*, a conventional latch needle 11 is shown. In accordance with the invention, the sinkers 10 have a modified profile at their uppermost area or neb 60, where the high level ledge 55 extends substantially horizontally along a straight line in a plane transverse to the axis of the needle cylinder. The lower ledge 56 is more or less conventional in form and position, and defines the lower border of a throat 61. The upper ledge 55 extends to a relatively sharp point 63 at the entrance of the throat 61 so that yarn fed above the point will not enter the throat while, conversely, yarn fed below it will be directed into the throat.

Figure 3A:
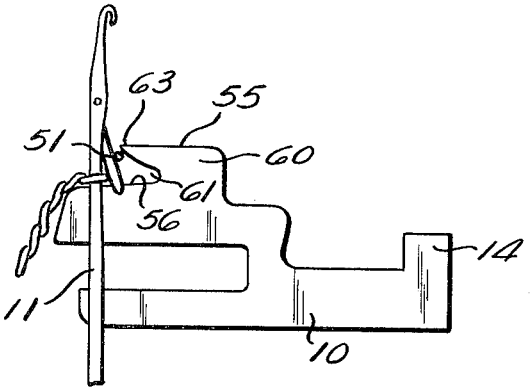
FIGS. 3*a*, *b*, *c*, *d*, and *e* schematically represent relative positions of needles and sinkers in the corresponding angular positions indicated by lines of the same letter designations in FIGS. 1 and 2.
Figure 3B:
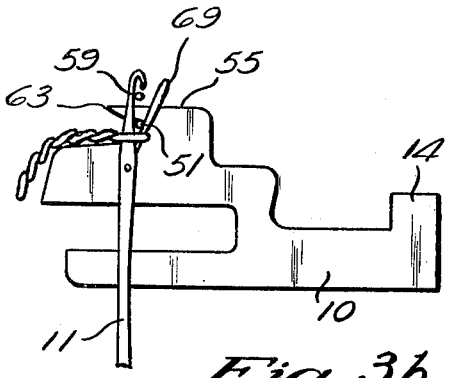

In FIG. 3*a*, the sinker 10 is withdrawn away from the needle circle by the central sinker cam 18 to permit the backing yarn 51 to enter the throat 61. The views of FIGS. 3*a* through 3*e* are taken along lines of corresponding letter designation indicated in FIGS. 1 and 2. In FIG. 3*b*, the sinker 10 is advanced along the cam surface 22 toward the needle circle, thereby capturing the backing yarn 51 in the throat 61 and moving the upper ledge 55 under the terry yarn 59. Simultaneously, the needle 11 has begun its descent towards drawing the yarns 51 and 59 into stitches.

Figure 3C:
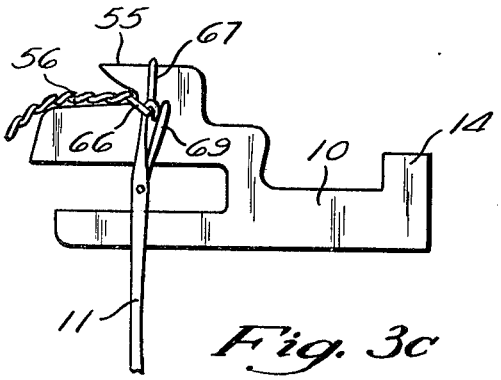

In FIG. 3*c*, the needle 11 has been drawn to its knockover position, and thus measures the respective lengths of a regular or backing yarn loop 66 and a terry loop 67. The relative differential length of these loops 66 and 67 is generally determined by the vertical spacing between the ledges 55 and 56. At the left of FIG. 4, a needle 11*a* is shown drawing both yarns 51 and 59 over their respective ledges 56 and 55 at the point of needle knockover.

Figure 3D:
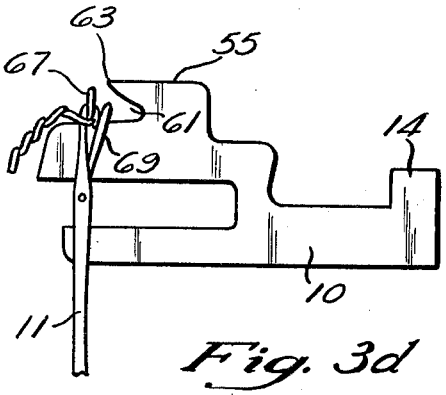
Figure 3E:
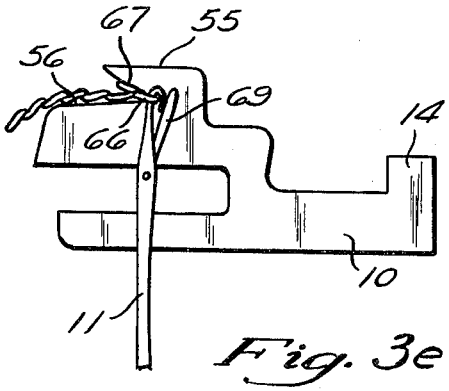

In FIG. 3*d*, the needle 11 has risen slightly to welt height to relieve tension in the yarns 51 and 59 and the sinker 10 has been withdrawn by the cam surface 29, thereby releasing the terry loop 67 from the ledge 55. Study of FIGS. 1 and 2 reveals that substantially all of the withdrawal motion of the sinker 10 occurs after the needle is out of reciprocatory motion at the welt position.

From the withdrawn position of FIG. 3*d*, the sinker 10 is then advanced along the trailing cam surface 30 to capture the terry loop 67 in the sinker throat 61 while the needle is still in the welt position. With the terry loop now contained in the sinker throat, the needle 11 may rise to tuck height and then to clear height, with the latch, designated 69, of the needle reliably clearing the terry loop 67 and, of course, the regular loop 66. Since the position of the terry loop 67 is now controlled by the sinker, it is impossible for the latch 69 to reenter the loop 67 upon its descent at the subsequent feed station, as has been previously experienced in the prior art.

It may be appreciated that, in accordance with the invention, the withdrawal and readvance of the sinkers 10 to control the position of the terry loops 67 are accomplished at the most favorable time during the knitting cycle, when the reciprocatory motion of the needles is stopped at the welt position. This technique reduces the effect of slight deviations in the motion of the knitting elements and yarn, owing to frictional differences in the system, and which would otherwise affect the quality and uniformity of the product. Terry fabric as produced in accordance with the invention may be advantageously used, for example, in specific portions of fine gauge ladies' hosiery, where fabric quality and uniformity are particularly important.

Referring to FIG. 1, the sinker cam ring 12 includes a pivotal cam element 71 adjacent the trailing cam surface 22 of the central sinker cam. The pivotal cam 71 is connected by a link (not shown) to a movable cam body 73. The pivotal cam member 71 operated by its link connection with the cam 73 and, in turn, a suitable linkage between the cam 73 and a conventional patterning mechanism of the knitting machine swings on a pin 74 radially outward to cover the adjacent cam surface 22. The outwardly positioned cam 71 extends the period of sinker withdrawal during bare needle makeup, to provide more conventional timing by delaying advance of the sinkers 10.

An additional cam 76, shown at the lower portion of FIG. 1, is provided on the sinker cam body 12 at an angular position corresponding to a conventional transfer station. This cam 76 withdraws the sinkers 10 at the transfer point to prevent the transfer loops from being distorted by engagement with the sinkers of the disclosed profile as they are transferred to the transfer jacks.

FIGS. 1 and 2 illustrate cam elements in a two-feed machine, with the second feed station designated generally at 79 (FIG. 2). A first sinker cam 81 is equivalent to the central sinker cam 18, and a pivotal cam 82 on it is equivalent to the first-mentioned pivotal cam 71. Similarly, a sinker withdrawal cam 84 is equivalent to the sinker withdrawal cam 28. While the needle path illustrated in FIG. 2 represents the knitting of plain or jersey plated fabric, it is contemplated that various other knit structures may be produced with terry loops formed in the disclosed manner in accordance with the invention.

Although a preferred embodiment of the invention is disclosed, it is to be understood that various modifications and rearrangements of the elements or steps may be resorted to without departing from the scope of the invention as taught and claimed herein.

What is claimed is:

1. In a circular knitting machine having needles and sinkers, means for controlling the motion of the needles including a stitch cam for drawing the needles to form stitches, cam means for raising the needles to clear height subsequent to being drawn by said stitch cam, said sinkers having first and second yarn drawing ledges adapted to form regular and elongated loops respectively, a yarn feeding station having first and second yarn feeding means for feeding separate yarns to said first and second sinker ledges respectively, first sinker cam means for withdrawing said sinkers in preparation for feeding yarn at said feed station, first sinker cam means for advancing the sinkers in a zone between the feed station and stitch drawing station to a position where the yarns of the first and second feeding means are laid over the first and second sinker ledges respectively, second sinker cam means for withdrawing the sinkers substantially immediately after said yarns have been fully drawn into stitches at said stitch cam to permit said second yarn to be transferred from the second ledge to the throats of said sinkers, and second sinker cam means for advancing said sinkers before the needles are raised substantially above knockover height whereby the loops formed by said second yarn are restrained in said throats when said needles are raised to clear height by said cam means to assure reliable clearing of the loops of both of said yarns.

2. Apparatus as set forth in claim 1, wherein said needle motion control means includes means for raising the needles to welt height after full draw and said second sinker cam withdrawal means is effective substantially after said needles are raised to welt height.

3. Apparatus as set forth in claim 2, wherein said second sinker cam advancing means is effective before said needles are substantially raised from welt height by said needle motion control means.

4. Apparatus as set forth in claim 1, wherein said first sinker advancing cam means includes means for selectively producing two modes of operation, the first of said modes being effective during knitting of terry fabric and allowing said sinkers to advance prematurely to facilitate laying of said yarns on their respective ledges, the second of said modes being effective to allow relatively conventional sinker advance timing for bare needle makeup.

5. Apparatus as set forth in claim 4, wherein said selective means includes a cam member pivotal on a sinker cam ring body.

6. A method of knitting terry fabric in a circular knitting machine, comprising the steps of feeding two yarns to the needles and sinkers, providing at least some of the sinkers with regular loop forming ledges adjacent their throats and separate terry loop forming ledges, advancing the sinkers towards the needles adjacent the feed station to cause one of said yarns to be laid across the regular loop forming ledge and the other yarn to be laid across the terry loop forming ledge, fully drawing the yarns to form stitches by moving said needles to a position of maximum draw at a stitch cam, substantially immediately after said yarns are drawn to stitches by the stitch cam withdrawing the sinkers away from the needle circle to cause the terry loops to move from their associated ledges into the sinker throats, and returning the sinkers towards the needle circle before said needles are substantially raised above knockover height to cause the loops of both yarns to be held in said throats while said needles are raised by a cam to clear height.

7. The method as set forth in claim 6, wherein the sinkers are withdrawn to transfer the terry loops substantially while the needles are welting.

8. The method as set forth in claim 7, wherein said sinkers are returned while said needles are welting.

* * * * *